US012791275B2

(12) United States Patent
Cavner

(10) Patent No.: US 12,791,275 B2
(45) Date of Patent: Nov. 10, 2026

(54) AMBIDEXTROUS BOLT CATCH AND RELEASE ASSEMBLY, RECEIVER ASSEMBLY, AND FIREARM

(71) Applicant: William R. Cavner, Everett, WA (US)

(72) Inventor: William R. Cavner, Everett, WA (US)

( * ) Notice: Subject to any disclaimer, the term of this patent is extended or adjusted under 35 U.S.C. 154(b) by 169 days.

(21) Appl. No.: 18/744,212

(22) Filed: Jun. 14, 2024

(65) Prior Publication Data

US 2026/0043629 A1 Feb. 12, 2026

(51) Int. Cl.

| | |
|---|---|
| ***F41A 17/42*** | (2006.01) |
| ***F41A 3/66*** | (2006.01) |
| ***F41A 3/72*** | (2006.01) |
| ***F41A 17/36*** | (2006.01) |
| ***F41A 35/06*** | (2006.01) |

(52) U.S. Cl.

CPC ..... *F41A 17/36* (2013.01); *F41A 3/66* (2013.01); *F41A 3/72* (2013.01); *F41A 35/06* (2013.01)

(58) Field of Classification Search

CPC ..... F41A 3/68; F41A 17/36; F41A 17/42
See application file for complete search history.

(56) References Cited

U.S. PATENT DOCUMENTS

| | | | | |
|---|---|---|---|---|
| 8,161,861 | B2 | 4/2012 | Haley | |
| 8,359,966 | B1 | 1/2013 | Brotherton | |
| 9,291,412 | B1 | 3/2016 | Montes | |
| 9,417,020 | B2 | 8/2016 | McGinty | |
| 9,494,378 | B2 | 11/2016 | Gomez | |
| 9,541,339 | B2 | 1/2017 | Orne, III | |
| 9,557,125 | B2 | 1/2017 | Stewart | |
| 9,651,328 | B1 * | 5/2017 | Oglesby | F41A 35/06 |
| 9,952,011 | B2 * | 4/2018 | Overstreet | F41A 17/36 |
| 10,018,437 | B2 * | 7/2018 | Phipps | F41A 17/42 |
| 10,197,353 | B2 | 2/2019 | Lewis | |
| 11,512,920 | B1 * | 11/2022 | Oglesby | F41A 17/42 |
| 11,530,886 | B2 * | 12/2022 | Bray | F41A 3/68 |
| 11,536,531 | B1 * | 12/2022 | Geissele | F41A 35/02 |
| 12,123,668 | B2 * | 10/2024 | Kolev | F41A 35/06 |
| 2005/0183310 | A1 * | 8/2005 | Finn | F41A 17/42 42/49.01 |
| 2010/0275485 | A1 * | 11/2010 | Findlay | F41A 35/06 42/16 |
| 2012/0167424 | A1 * | 7/2012 | Gomez | F41A 35/06 42/14 |
| 2016/0258696 | A1 | 9/2016 | Fluhr | |
| 2018/0347925 | A1 * | 12/2018 | Gibbens | F41A 9/59 |
| 2019/0093978 | A1 * | 3/2019 | Maugham | F41A 17/36 |
| 2020/0182571 | A1 * | 6/2020 | Noonan | F41A 3/66 |
| 2020/0263944 | A1 * | 8/2020 | Harris | F41A 17/36 |

(Continued)

*Primary Examiner* — Derrick R Morgan

(74) *Attorney, Agent, or Firm* — Trendak IP Law LLC; Paul N Dunlap

(57) ABSTRACT

A bolt catch assembly for a firearm lower receiver having a symmetrical and ambidextrous finger pad in an ergonomic location at the front of the trigger-well which operates the catch and release function of the bolt catch. The finger pad moves in a vertical motion; up to catch the bolt, and down to release the bolt. It may be operated from the left or the right finger pad by a left-hand finger or a right-hand finger. The finger pad is affixed to a vertical link which has a tooth at its top end which engages a groove on the edge of the bolt catch to make the bolt catch pivot. The vertical link includes an elongated slot that accommodates a magazine release shaft.

15 Claims, 8 Drawing Sheets

(56) References Cited

U.S. PATENT DOCUMENTS

| | | | | |
|---|---|---|---|---|
| 2021/0164747 | A1* | 6/2021 | Denson, III | F41A 9/59 |
| 2021/0180900 | A1* | 6/2021 | Markut | F41A 3/72 |
| 2021/0222971 | A1* | 7/2021 | Bray | F41A 17/34 |
| 2021/0270551 | A1* | 9/2021 | Underwood | F41A 35/06 |
| 2021/0278156 | A1* | 9/2021 | Davidson | F41A 9/70 |
| 2022/0187035 | A1* | 6/2022 | Irons | F41A 17/42 |
| 2022/0196361 | A1* | 6/2022 | Nedev | F41A 3/66 |
| 2023/0003482 | A1* | 1/2023 | Markut | F41A 35/02 |
| 2024/0247890 | A1* | 7/2024 | Underwood | F41A 17/36 |
| 2025/0237466 | A1* | 7/2025 | Osborn | F41A 17/42 |
| 2026/0153295 | A1* | 6/2026 | Dueck | F41A 3/26 |

* cited by examiner

AMBIDEXTROUS BOLT CATCH AND RELEASE ASSEMBLY, RECEIVER ASSEMBLY, AND FIREARM

BACKGROUND OF THE INVENTION

This invention relates generally to an ambidextrous bolt catch and release assembly for a firearm, more particularly to an ambidextrous bolt catch and release assembly for firearms such as the AR15/M4/M16 type, as well as to a receiver assembly implementing the bolt catch assembly and a firearm with the receiver assembly.

Conventional AR15/M4/M16-type firearms generally include a magazine, trigger, bolt, safety, bolt catch, and magazine release. The magazine feeds ammunition into the chamber, and when the last round is fired, the bolt catch assembly is activated to catch the bolt in the open position. The magazine release allows the empty magazine to removed and replaced with a loaded magazine. The bolt release is then activated to release the bolt and permit more rounds to be fired. The lower receiver is the main body of the firearm and holds the bolt, the magazine, the trigger, and the various mechanisms such as the magazine release, safety, and bolt catch and release. In the conventional design, the magazine release is on the right side of the receiver, while the safety and the bolt release are on the left side of the receiver. Thus, both hands are generally needed to operate the firearm, and the left-hand operates different features than the right-hand. The purpose of ambidextrous designs is to enable one hand to operate all functions, and that one hand may be either the right hand or the left hand. Thus, "ambidextrous" means a particular function can be operated from either side of the firearm, i.e., with either left-handed or right-handed operation.

It may also be advantageous for a firearm function to be symmetrical so that whether it is operated with the left or the right hand, the function feels the same, and uses the same motions. Thus, "symmetrical" means both sides of the receiver's mechanical functions are performed identically, and the operator does not need to remember one side is different than the other.

A further design goal is for the function to be ergonomic. "Ergonomic" means the operator does not need to stretch unreasonably, or grossly move their hand or fingers to perform the basic functions of the weapon. Preferably the operations can be carried out without releasing one's grip on the weapon.

The conventional design does not allow for ambidextrous function and is not very ergonomic, i.e., it does not provide a quick way to operate the mechanism without displacing the operator's hands from their normal shooting positions. Other manufacturers have tried to improve the design by various means. It has been relatively simple to extend the magazine release through both sides of the receiver with similar buttons on both sides, thus making it ambidextrous and somewhat symmetric. Likewise for the safety mechanism. However, the bolt catch and release mechanism has not been so simple to make ambidextrous and symmetric while maintaining ergonomic function.

U.S. Pat. No. 8,359,966 B1 to Brotherton discloses a simple extension of the bolt catch that protrudes out the right side of the receiver. This allows the shooter to use their right index finger to raise or lower the bolt catch without completely breaking their grip. This mechanism is not symmetrical. U.S. Pat. Pub. No. 2016/0258696 A1 to Fluhr et al. is another example of simply extending a second button from the bolt release on the other side of the firearm.

U.S. Pat. Pub. No. 2012/0167424 A1 to Lewis and U.S. Pat. No. 10,197,353 B2 to Lewis disclose a second bolt catch button added on the right side with a similar pivoting action that meshes with the factory bolt catch via teeth and grooves. This mechanism is not symmetrical or ergonomic.

U.S. Pat. No. 11,512,920 B1 to Oglesby discloses an ambidextrous bolt catch assembly that uses a second pivotable bolt release part with a button on the right side of the receiver. The second pivotable bolt release part has a tooth-like portion that interacts with a groove on the conventional right-side bolt release to pivot the left-side bolt release and release the bolt when the button on the right side is pushed. The mechanism is not symmetrical or ergonomic.

U.S. Pat. Nos. 8,161,861 B2 and 9,291,412 B2 to Montes disclose a curved lever that extends from the bolt catch button around the underside of the firearm, through the trigger guard area, until it projects slightly on the opposite side of the firearm, allowing ambidextrous operation. This approach is not symmetric or entirely ergonomic and the exposed lever may create other problems in use. The lever is designed to only aid right-handed operation and does not provide any protrusion for left-handed use for releasing the bolt.

U.S. Pat. No. 9,651,328 B1 to Oglesby discloses an ambidextrous and symmetric bolt release having a release lever in the trigger well that operates the bolt catch by a connector bar extending from the release lever to the bolt release and attached to the bolt release via a hook on the bar that engages a projection on the bolt catch. Also disclosed is a spring and biasing rod. The design involves quite a few parts and modifications making it impractical for widespread adoption. For example, Oglesby cuts away a portion of the magazine release shaft to try to avoid interference with the release lever, thus weakening the shaft.

In general, manufacturers have been able to provide a solution that is either ambidextrous or nearly symmetrical, but not both ambidextrous and symmetrical while also being entirely ergonomic and cost effective.

SUMMARY OF THE INVENTION

The present invention is directed to systems and methods which provide a bolt catch and release assembly that combines all three attributes of being ambidextrous, symmetrical, and ergonomic in a lower receiver of a firearm exemplified by the M16/M4/AR-15 types of firearms.

In one embodiment, the bolt catch assembly includes three main components: an enhanced bolt catch, a vertical link, and a symmetric and ambidextrous finger pad. The vertical link connects the finger pad to the bolt catch. The vertical link engages the bolt catch via an added notch in the bolt catch and a complementary tooth on the vertical link, so that vertical motion of the finger pad and vertical link pivotably operates the bolt catch.

The invention is also directed to a lower receiver assembly that includes a lower receiver having a newly added, vertical-link slot between the bolt catch channel and the trigger well. The receiver assembly includes the bolt catch assembly. The vertical link resides in the vertical-link slot. The finger pad resides in the trigger well and may be firmly attached to the lower end of the vertical link. The vertical link may have an elongated slot through which the magazine release shaft may pass without interfering with the operation of the vertical link. The vertical link may have threaded holes at the bottom aft side to allow an ambidextrous finger pad to be bolted or screwed onto it. The finger pad is provided with a symmetrical left and right finger grip and is fastened to the vertical link so that it is centered (from left to right) in the trigger well of the receiver. Preferably the finger pad is located at the front of the trigger well to prevent interference with operation of the trigger, which is near the back of the trigger well.

The invention is also directed to a firearm that includes the lower receiver assembly.

The invention is also directed to a method that includes the steps of providing a lower receiver with a vertical slot that begins at the top of the receiver, intersecting the right side of the original bolt catch slot, and extending down to the front-right area of the trigger well. This slot creates a space for a vertical link to be inserted and to slide in. The vertical link has an elongated hole in its mid-section which allows the vertical link to move freely, vertically, around the factory magazine release button and/or shaft. The bolt catch is provided with a groove or notch on its right side, i.e., opposite its pivot side, resulting in an enhanced bolt catch. The vertical link has a nub or tooth at the top which interfaces with the groove or notch in the enhanced bolt catch.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

The accompanying drawings, which are incorporated in and form part of the specification in which like numerals designate like parts, illustrate embodiments of the present invention and together with the description, serve to explain the principles of the invention. In the drawings.

DETAILED DESCRIPTION

An embodiment of the symmetrical ambidextrous ergonomic bolt catch and release is illustrated by the various figures. The figures will be introduced generally and then described in more detail.

Figure 1:
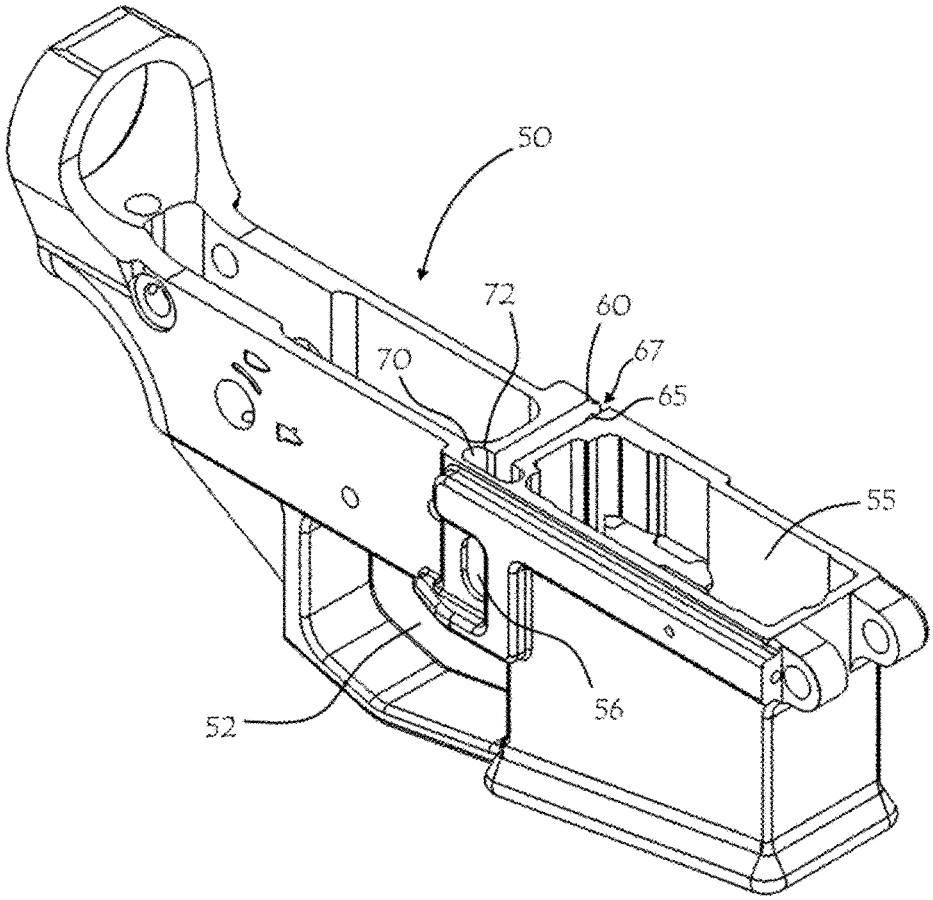
FIG. 1 is a right, front, top perspective view of a receiver according to an embodiment of the invention.
Figure 2:
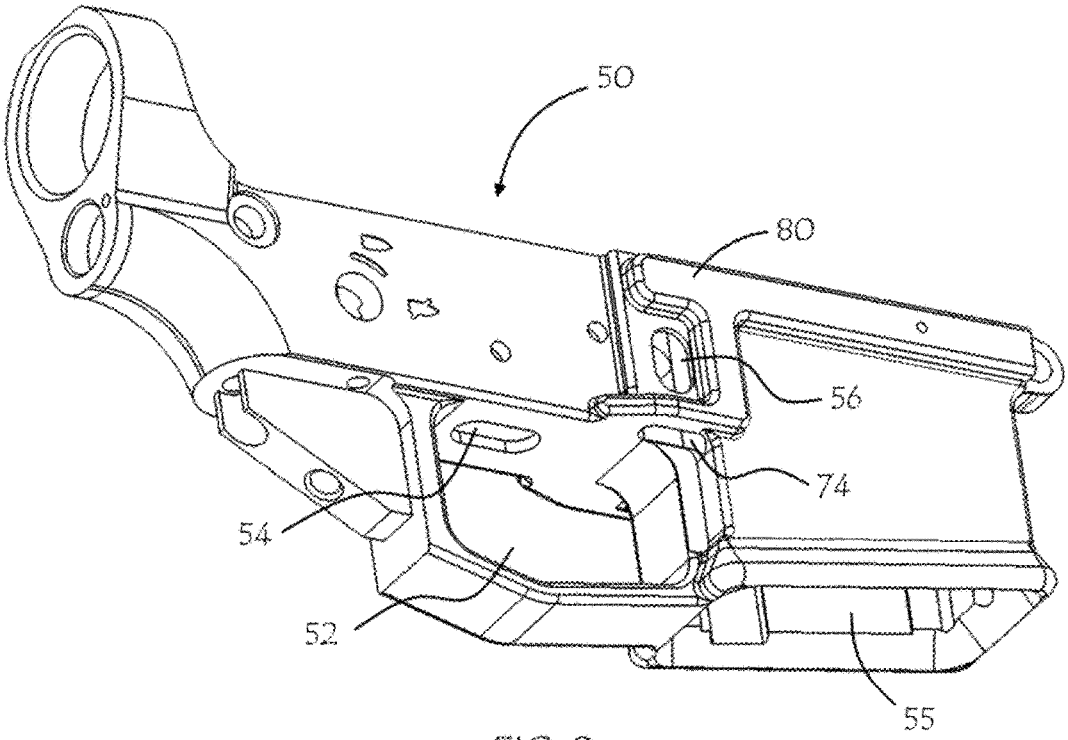
FIG. 2 is a right, rear, bottom perspective view of a receiver according to an embodiment of the invention.
Figure 3:
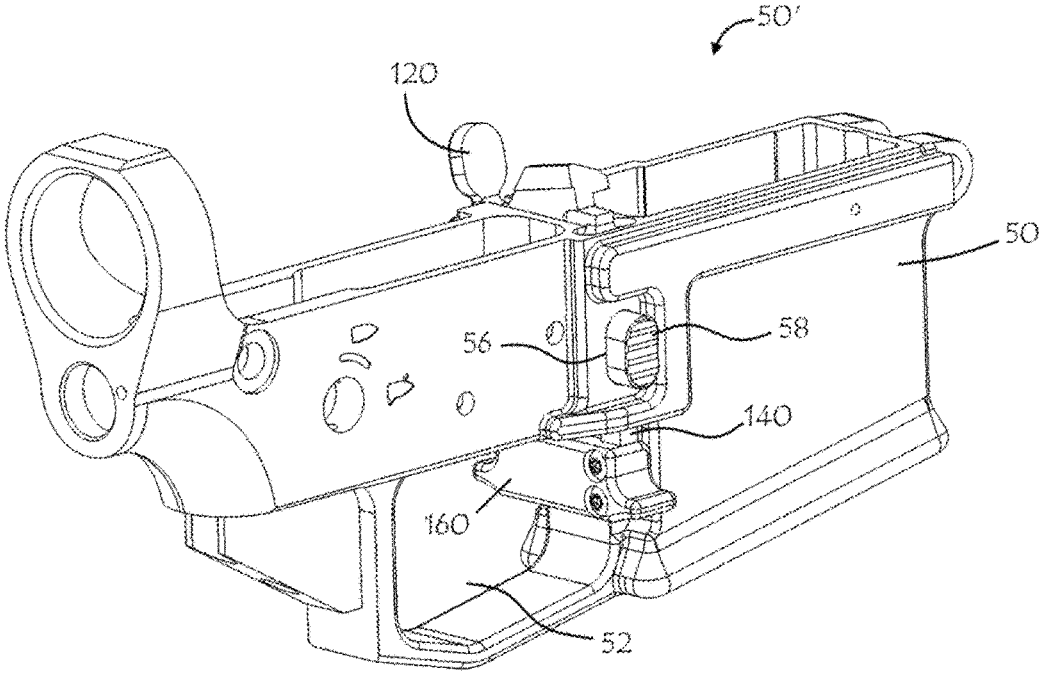
FIG. 3 is a right, rear, top perspective view of a receiver holding the ambidextrous bolt release mechanism according to an embodiment of the invention.
Figure 4:
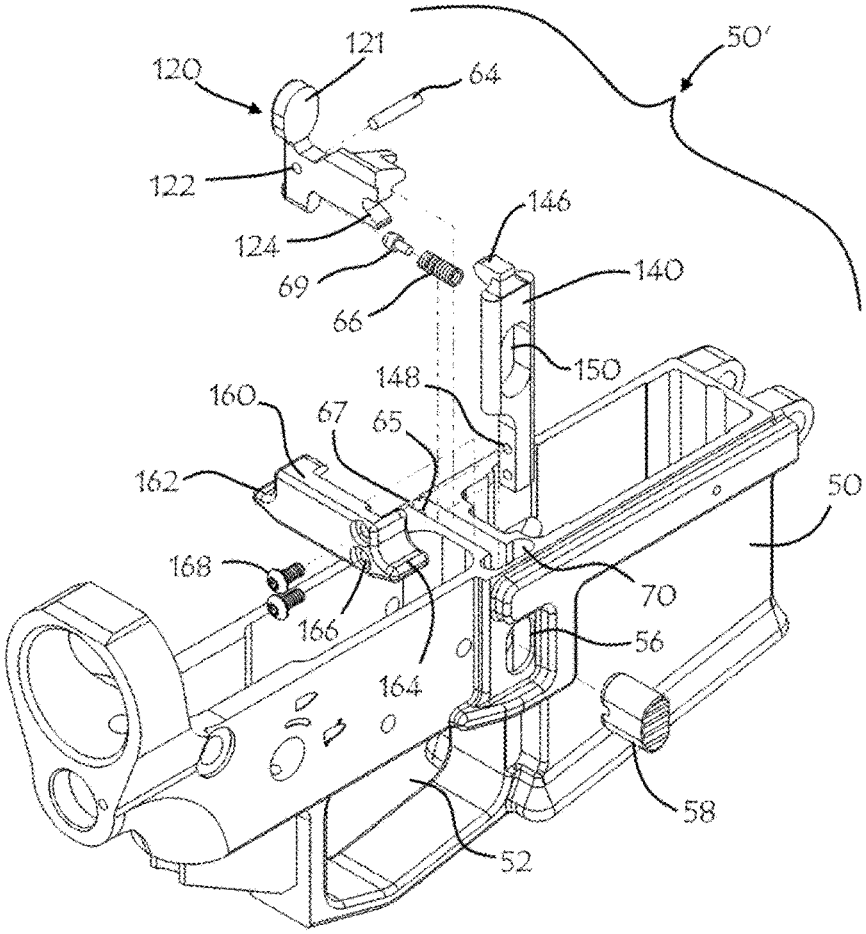
FIG. 4 is an exploded view of the embodiment of FIG. 3.
Figure 5:
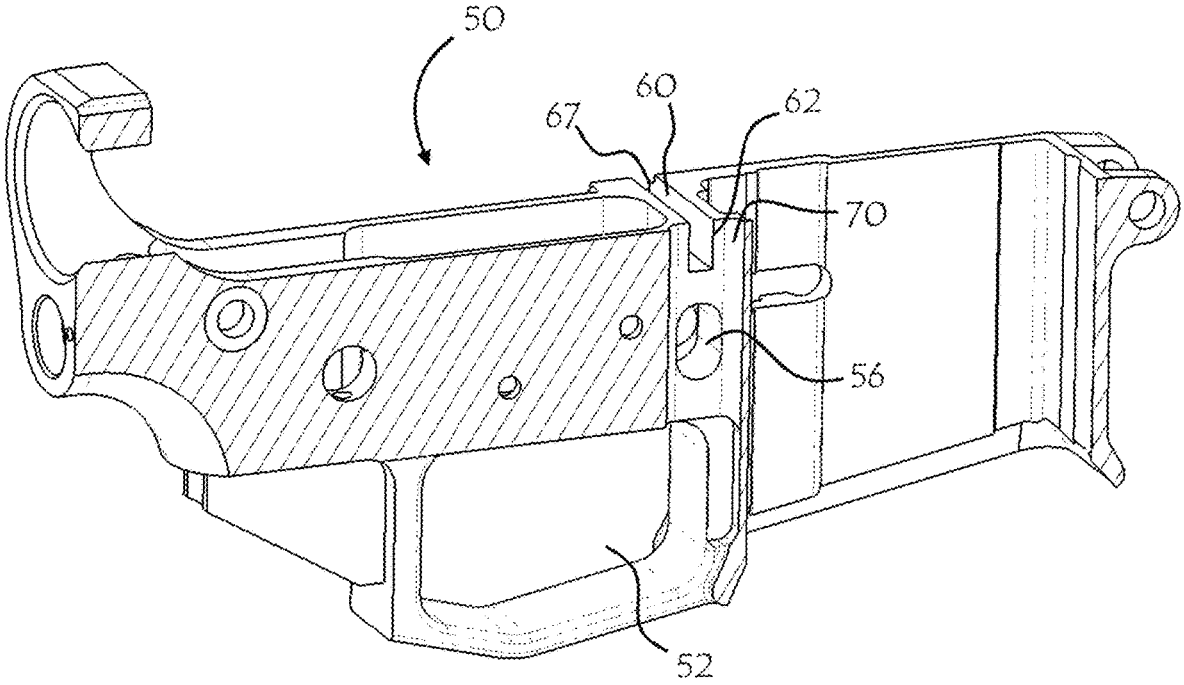
FIG. 5 is a partially fragmented perspective view of the receiver of FIG. 1.
Figure 6:
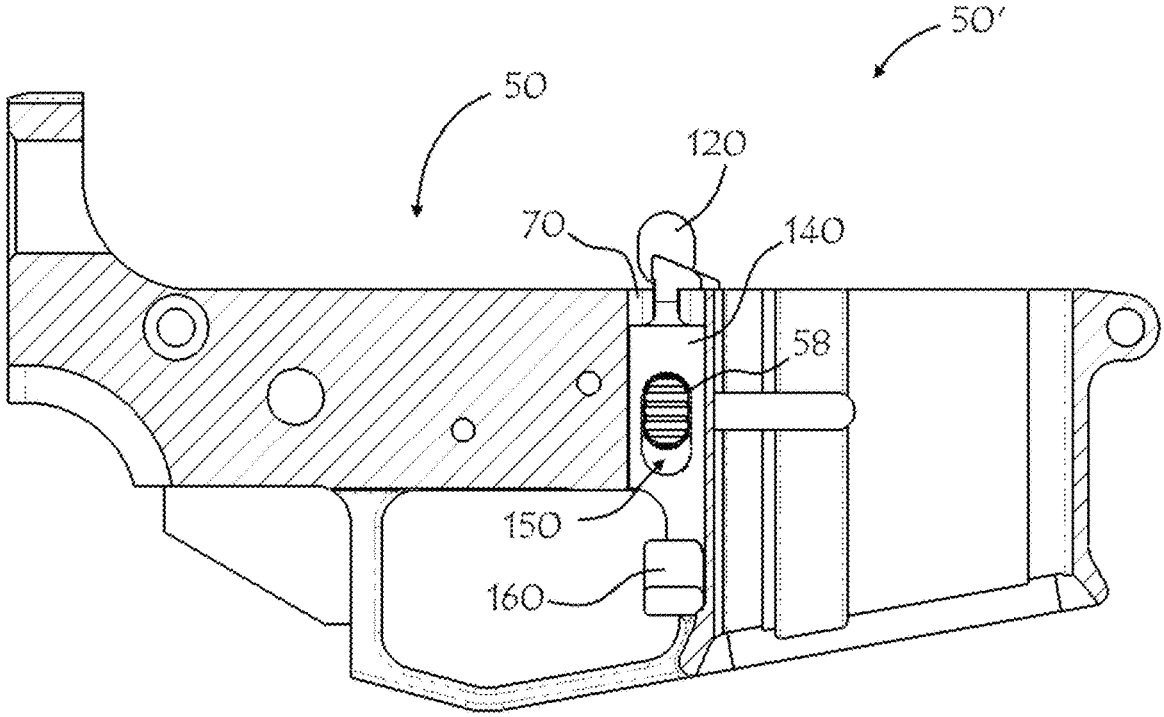
FIG. 6 is a partially fragmented right elevation of the receiver of FIG. 3.
Figure 7:
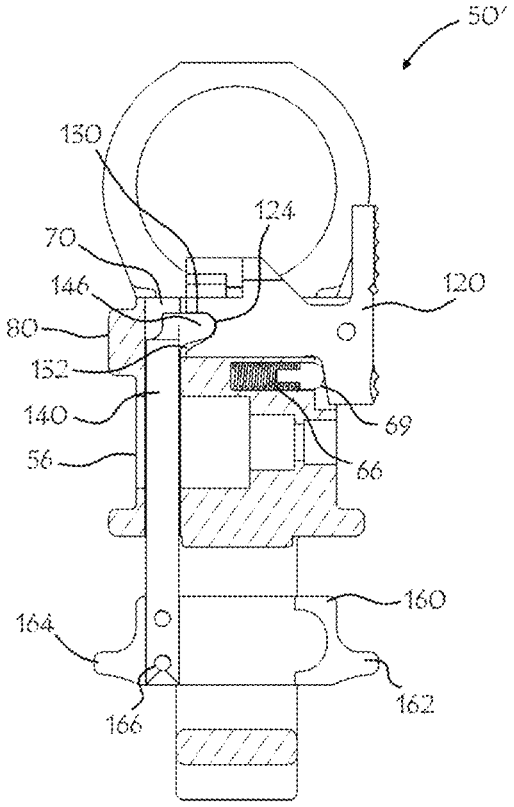
FIG. 7 is a partially fragmented front elevation of the receiver of FIG. 3 with the bolt catch in the lowered position.
Figure 8:
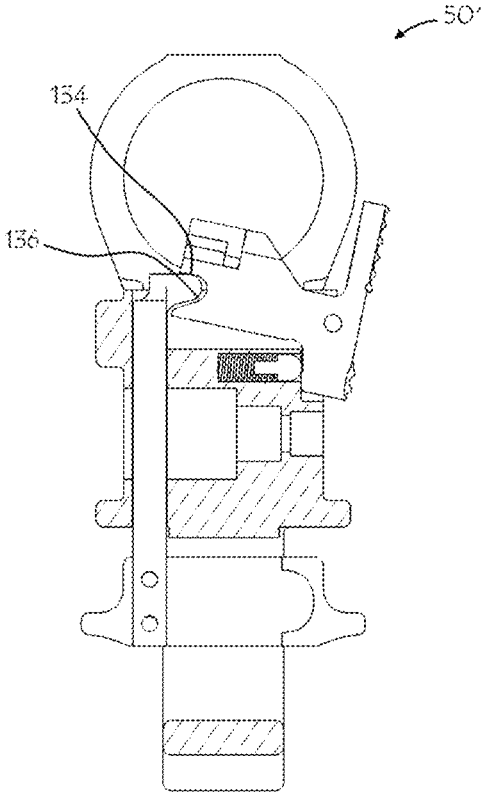
FIG. 8 is a partially fragmented front elevation of the receiver of FIG. 3 with the bolt catch in the raised position.
Figure 9:
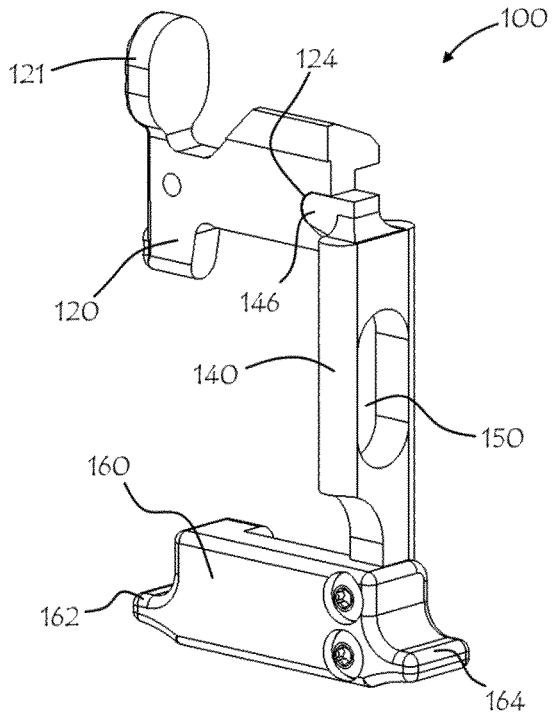
FIG. 9 is a perspective view of the ambidextrous bolt catch and release assembly.
Figure 10:
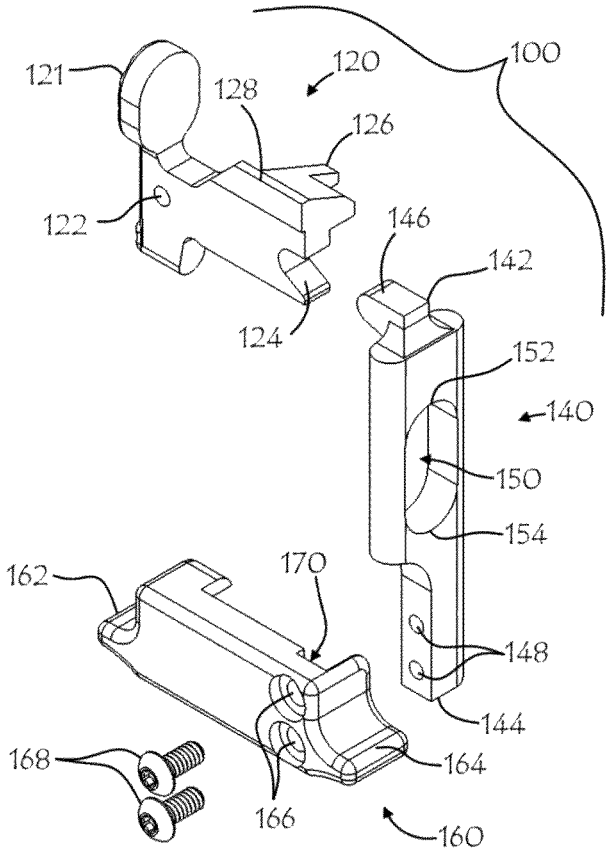
FIG. 10 is an exploded perspective view of the ambidextrous bolt catch and release assembly of FIG. 9
Figure 17:
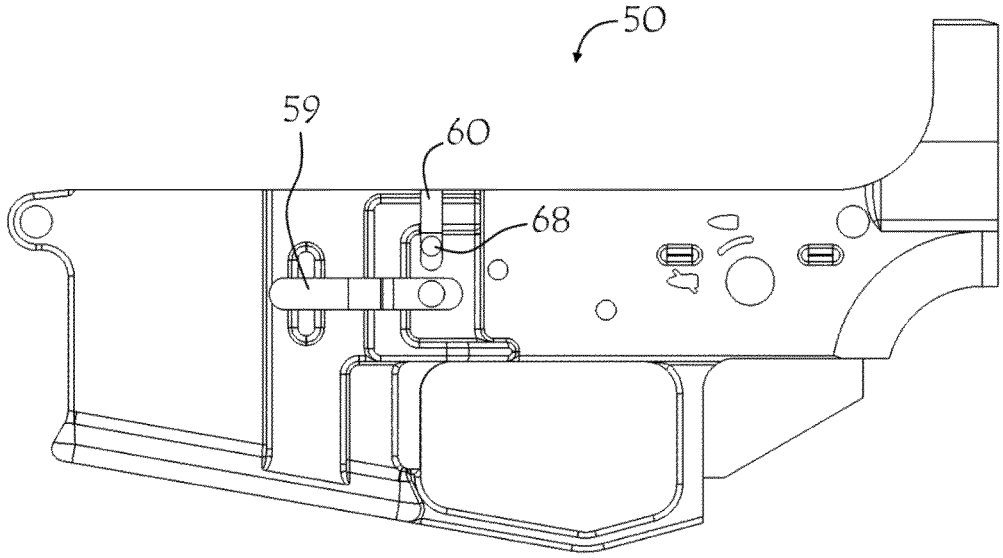
FIG. 17 is a left-side elevation view of the receiver of FIG. 1.

FIGS. 1, 2, and 5 show the lower receiver (or simply, receiver 50), which is modified from the conventional M4/AR15 design in order to accommodate the inventive ambidextrous bolt catch and release. FIGS. 9 and 10 show ambidextrous bolt catch and release assembly 100. FIGS. 3, 4, and 6 show receiver assembly 50' which includes receiver 50 with ambidextrous bolt catch and release assembly 100 installed therein. FIGS. 7 and 8 illustrate the operation of bolt catch and release assembly 100. FIGS. 11-16 show the individual components of the bolt catch and release assembly 100. While FIGS. 1-6 view receiver 50 from the right side, FIG. 17 views receiver 50 from the left side.

In the figures, receiver 50 includes trigger well 52 and trigger opening 54 through which a trigger (not shown) can protrude into the trigger well. Receiver 50 also has magazine well 55 and magazine button hole 56 which accommodates right side magazine release button 58 and optionally left side magazine release button 59 for ambidextrous operation of the magazine release (not shown). Bolt catch channel 60 houses enhanced bolt catch 120, which pivots on bolt catch pivot pin 64 when installed through bolt catch pivot pin hole 122 into pivot pin hole 65 in receiver 50.

Pivot pin hole 65 is located near the left side of receiver 50 in bolt catch channel 60. Bolt catch channel 60 passes from the left side of receiver 50 to the right side of receiver 50. The left side of bolt catch channel 60 is wide open at left side opening 67 for inserting enhanced bolt catch 120 and so that the conventional bolt release button is accessible outside receiver 50. In the conventional receiver, the bolt catch channel stops short of the right side of the receiver since there the conventional bolt catch does not protrude from the right side of the receiver. In the inventive design, the right end of bolt catch channel 60 opens into a new, wider, vertical-link slot 70 at right side opening 62. Vertical link slot 70 extends vertically downward from its top opening 72 to its bottom opening 74 in the top of trigger well 52 and near the front of trigger well 52 just behind magazine well 55.

In the M4/AR15 style receiver, the shaft that connects the right magazine release button 58 and the left magazine release button 59 extends horizontally through the receiver in magazine button hole 56 that runs below and parallel to the bolt catch channel. In the invention, therefore, vertical-link slot 70 intersects the horizontal magazine button hole 56. Vertical-link slot 70 is substantially wider than bolt catch channel 60 and wider than magazine button hole 56. Vertical-link slot 70 accommodates vertical link 140.

Three components make up the bolt catch and release assembly 100, namely enhanced bolt catch 120, vertical link 140, and ambidextrous finger pad 160. FIG. 9 shows bolt catch and release assembly 100 assembled, and FIG. 10 shows it exploded. FIGS. 3 and 4 show the bolt catch and release assembly 100 assembled and exploded respectively in or with receiver 50.

Figure 11:
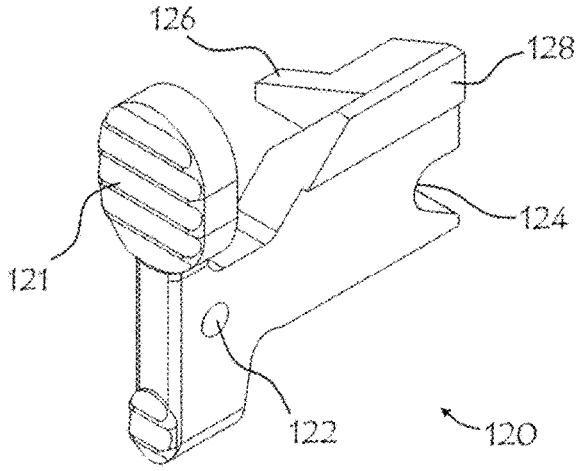
FIG. 11 is a perspective view of the enhanced bolt catch according to an embodiment of the invention.
Figure 12:
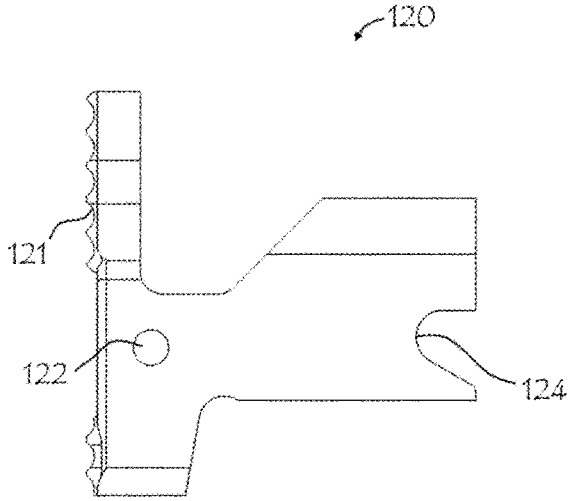
FIG. 12 is a side elevation view of the enhanced bolt catch of FIG. 11.

Enhanced bolt catch 120 may be similar to the conventional bolt catch but with an added groove 124 on the end opposite bolt catch button 121 and opposite the bolt catch pivot pin hole 122. Bolt catch 120 may also have a conventional catch projection 126 and bolt carrier stop 128 as shown in FIGS. 10-12. The bolt catch projection interacts with the magazine when the magazine is empty.

Figure 18:
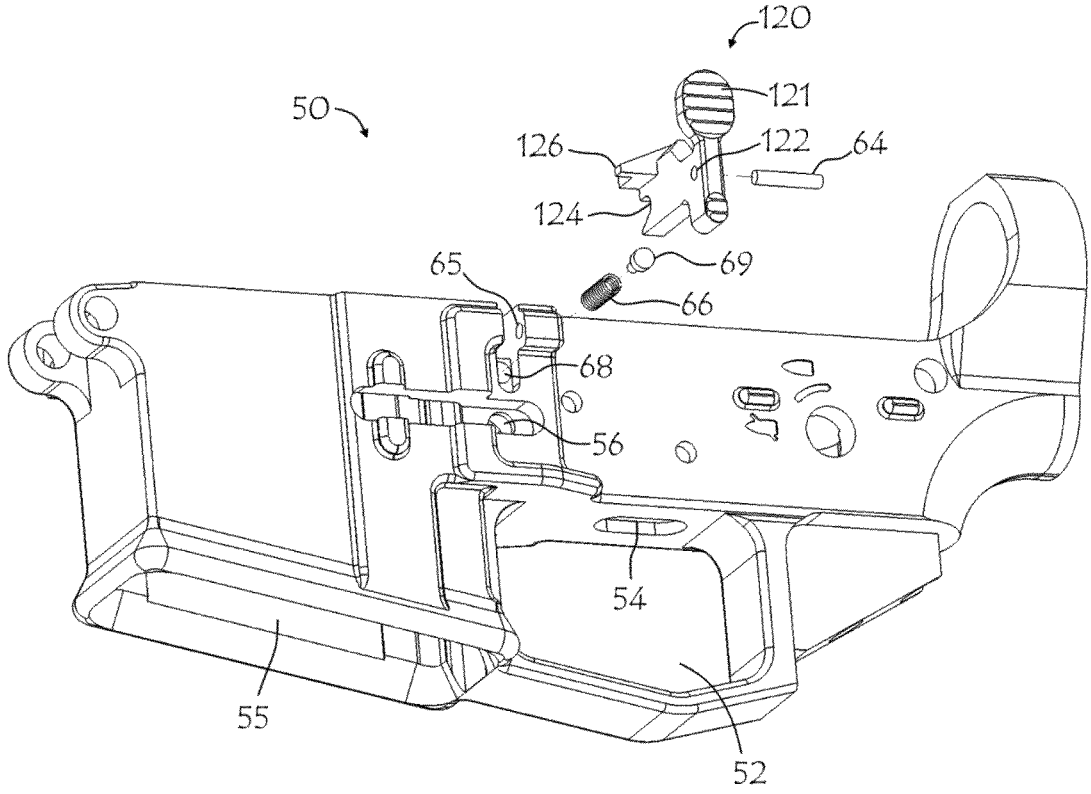
FIG. 18 is a left-side, exploded, perspective view of the receiver of FIG. 1 with the enhanced bolt catch of FIG. 11.

FIG. 18 shows bolt catch spring 66, which is set into bolt catch plunge hole 68. The spring 66 is compressed between the bottom of plunge hole 68 and the bolt catch, thus biasing the bolt catch into the lowered position shown in FIG. 7. Bolt catch plunger 69 is mounted in the end of spring 66 to provide a good contact point with the bolt catch for smooth operation of the bolt catch.

Vertical link 140 extends through the vertical-link slot to operationally connect ambidextrous finger pad 160 to enhanced bolt catch 120. Ambidextrous finger pad 160 may be rigidly connected to vertical link 140 using fasteners such as finger pad fasteners 168, shown in the figures as screws which pass through finger pad fastener thru-holes 166 and screw into finger-pad attachment holes 148 near the lower end 144 of vertical link 140. Alternatively, finger pad 160 and vertical link 140 may be one unitary piece. Finger pad 160 may include a finger pad groove 170 adapted to mate with vertical link 140 to better resist movement between the two.

Near or at upper end 142 of vertical link 140 is vertical link tooth 146. Vertical link tooth 146 and enhanced bolt catch groove 124 have complementary shapes, so that they engage in a way that vertical movement of link 140 causes catch 120 to pivot. Thus, pushing on finger pad 160 moves vertical link 140 and pivots enhanced bolt catch 120. Finger pad 160 includes left finger pad grip 162 and right finger pad grip 164. Thus, enhanced bolt catch 120 may be operated with either finger pad grip (162 or 164) with in either a right handed or left handed shooting mode. Note that the ambidextrous finger pad 160 is centered within trigger well 52 while vertical link 140 resides in vertical-link slot 70 which is off center, namely to the right of center.

Engagement of vertical link tooth 146 with bolt catch groove 124 results in contact there between. FIG. 7 and FIG. 8 show the positioning of and the contact between the tooth and the groove when the bolt catch is in the lowered and raised positions, respectively. FIG. 7 shows the components assembled and in the lowered or resting or release position. FIG. 8 shows the components assembled and in the raised or bolt-catching position. The contact area 130 in lowered position may be the majority of the tooth and groove surfaces, but with a gap 132 between the upper surface of the groove and the lower surface of the tooth, as shown in FIG. 7. As the vertical link moves upward to pivot the catch, the groove moves upward and away from the tooth, creating a larger gap 136 and smaller contact area 134 as shown in FIG. 8. Thus, groove 124 must be somewhat larger than tooth 146, or in other words, tooth 146 must be smaller than groove 124.

Figure 13:
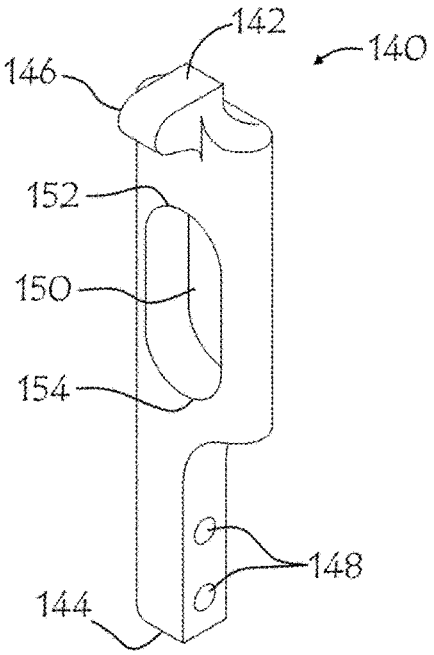
FIG. 13 is a perspective view of the vertical link according to an embodiment of the invention.
Figure 14:
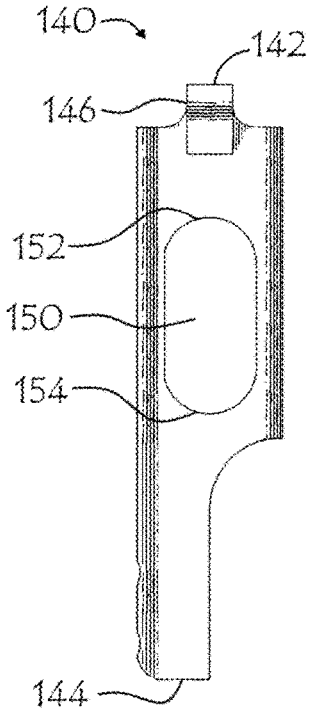
FIG. 14 is a side elevation view of the vertical link of FIG. 13.
Figure 15:
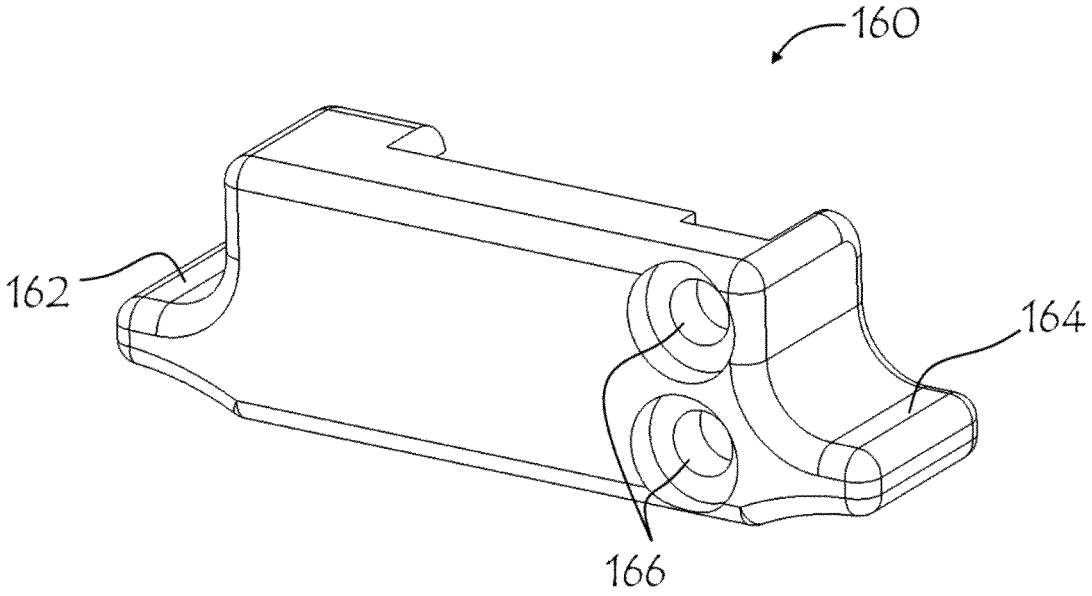
FIG. 15 is a front perspective view of the finger pad according to an embodiment of the invention.
Figure 16:
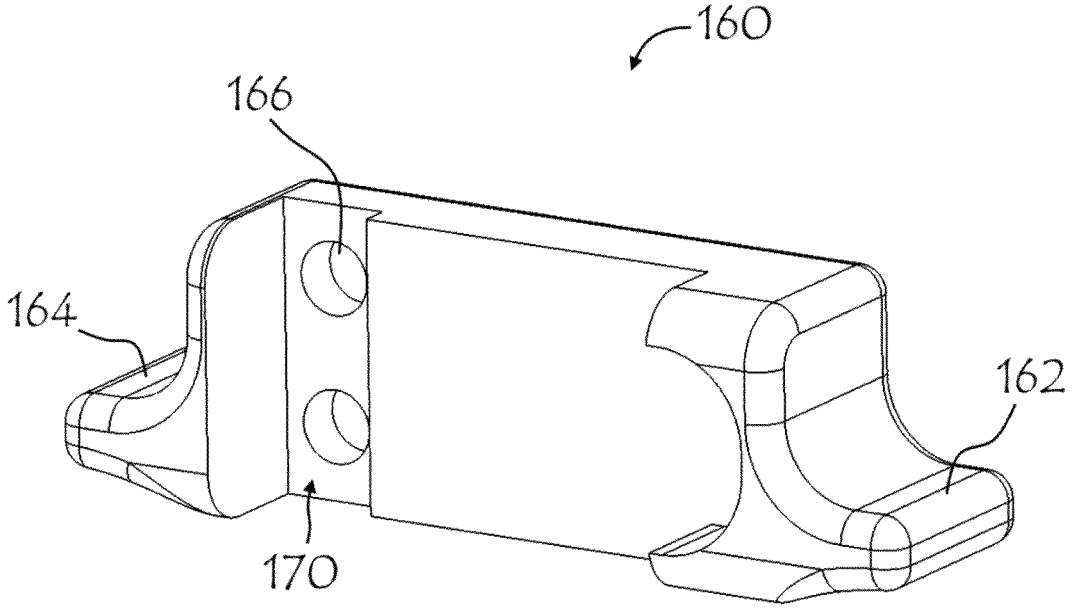
FIG. 16 is a rear perspective view of the finger pad according to an embodiment of the invention.

Vertical link 140 is not a simple, cylindrical, solid shaft. Vertical link 140 includes a midsection (between upper end 142 and lower end 144) that is widened enough to include a hole 150 that is large enough for the magazine release button 58 to pass thru the hole without interfering with the vertical motion of the vertical link 140. Likewise, the vertical link 140 does not interfere with the horizontal motion of the magazine release passing through the clearance hole 150. The vertical extent of the magazine release button clearance hole 150 defines magazine release button clearance hole upper limit 152 and magazine release button clearance hole lower limit 154, as shown in FIGS. 10, 13, and 14. The vertical link clearance hole 150 may thus interact with the magazine release to define the limits of vertical motion of the link, i.e., a predetermined amount or range of movement up and down in the vertical-link hole. The elongated hole must therefore be adequately sized to operate the enhanced bolt catch through its necessary range of pivoting motion.

Thus, the present invention is a modification to the original bolt catch/release design of the M16/M4/AR-15 lower receiver. The invention places a symmetrical and ambidextrous "finger pad" in an ergonomic location at the front of the trigger-well which operates the catch and release function of the bolt catch. The "finger pad" moves in a vertical motion; up to catch the bolt, and down to release the bolt. It may be operated from the left or the right finger pad by a left-hand finger or a right-hand finger.

The invention provides a method of modifying an M16/M4/AR-15 lower receiver to accommodate an ambidextrous bolt catch assembly. First, a vertical slot must be provided intersecting the right side of the original bolt catch slot. The vertical slot begins at the top of the receiver and extends down to the front-right area of the trigger-well. This slot creates a space for a vertical link to slide in. The vertical link has an elongated hole in its mid-section which allows the vertical link to move freely, vertically, around the factory magazine release button and/or shaft. It may be noted that the conventional AR-15 includes outer wall 80 with extra material, which may reinforce the vertical slot. The modifications may be provided by machining an existing lower receiver, or by forming a whole new lower receiver by known machining or molding methods.

The bolt catch is provided with a groove or notch on its right side, i.e., opposite its pivot side, resulting in an enhanced bolt catch. The bolt catch may be modification to an existing bolt catch or a newly formed enhance bolt catch. The vertical link has a nub or tooth at the top which interfaces with the groove or notch in the enhanced bolt catch. The vertical link is a new part made for the purpose.

The vertical link may have threaded holes at the bottom aft side to allow an ambidextrous finger pad to be bolted or screwed onto it, or other means of attaching the finger pad may be provided, including adhesive, unitary forming of both pieces as one, and the like. The finger pad is provided with a symmetrical left and right finger grip and is fastened to the vertical link so that it is centered (from left to right) in the trigger well of the receiver. Preferably the finger pad is located at the front of the trigger well to prevent interference with operation of the trigger, which is near the back of the trigger well. The finger pad is also a new part.

The present invention may be considered a modification or improvement to the original bolt catch/release design of the M16/M4 (military firearm) and the AR-15 (civilian firearm) lower receiver. The invention includes a symmetrical and ambidextrous "finger pad" in an ergonomic location at the front of the trigger-well to operate the catch and release function of the bolt catch. The "finger pad" moves in a vertical motion; up to catch the bolt, and down to release the bolt.

It should be noted that terms of direction and orientation used herein and in the claims are conveniently used with respect to the normal orientation of a firearm in use and are not intended to restrict or limit the invention or a firearm to use only in that orientation.

Although the present invention and its advantages have been described in detail, it should be understood that various changes, substitutions, and alterations can be made herein without departing from the scope of the invention as defined by the appended claims. Moreover, the scope of the present application is not intended to be limited to the particular embodiments of the process, machine, manufacture, composition of matter, means, methods, and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps. The invention disclosed herein may suitably be practiced in the absence of any element that is not specifically disclosed herein.

What is claimed is:

1. An ambidextrous bolt release assembly, comprising:

(a) an enhanced bolt catch pivotable about a bolt catch pivot pin between a bolt engagement and a bolt release position, wherein said bolt catch comprises a bolt catch button and a curved groove on end of the bolt catch opposite the bolt catch button;

(b) a vertical link extending from a lower end thereof to an upper end thereof, the upper end thereof comprising a tooth that engages the curved groove; and (c) an ambidextrous finger pad affixed to the lower end of the vertical link; whereby vertical movement of said finger pad results in vertical movement of said vertical link and rotation of said enhanced bolt catch about said pivot pin.

2. The ambidextrous bolt release assembly of claim 1 wherein said vertical link further comprises an elongated hole.

3. The ambidextrous bolt release assembly of claim 1 wherein the finger pad is affixed to the lower end of the vertical link with one or more screws or bolts.

4. The ambidextrous bolt release assembly of claim 1 installed within a lower receiver of a firearm.

5. A receiver assembly for a firearm comprising the ambidextrous bolt release assembly of claim 1.

6. The receiver assembly of claim 5 further comprising a bolt catch slot, a trigger well, and a vertical-link slot; wherein the vertical-link slot intersects a right side of the bolt catch slot and extends downward and opens into a front-right portion of a trigger-well.

7. The receiver assembly of claim 6 wherein the bolt catch slot houses the enhanced bolt catch which can pivot therein; and the vertical-link slot houses the vertical link which can slide vertically over a range of movement therein.

8. The receiver assembly of claim 7 further comprising a magazine button hole located below and parallel to the bolt catch slot; wherein the vertical-link slot intersects the magazine button hole and is wider than a diameter of the magazine button hole.

9. The receiver assembly of claim 8 wherein the vertical link further comprises a clearance hole in a mid-section of the vertical link approximately the diameter of the magazine button hole, and elongated in the vertical direction, so that the vertical link can move freely, vertically, a predetermined amount, without interference from any button or shaft which might be installed in the magazine button hole.

10. The receiver assembly of claim 9 further comprising a magazine release shaft residing in the magazine button hole; wherein the clearance hole allows the magazine release shaft to pass freely therethrough over the range of movement of the vertical link.

11. A firearm comprising the receiver assembly of claim 5.

12. A firearm comprising the receiver assembly of claim 10.

13. A method comprising:

(a) providing a lower receiver for a firearm with an enhanced bolt catch pivotable about a bolt catch pivot pin between a bolt engagement and a bolt release position, wherein said bolt catch comprises a bolt catch button and a curved groove on an end of the bolt catch opposite the bolt catch button;

(b) providing the lower receiver with a vertical-link slot wherein the vertical-link slot intersects a right side of a bolt catch slot and extends downward and opens into a front-right portion of a trigger-well;

(c) providing a vertical link in the vertical-link slot having an upper end comprising a tooth that engages the curved groove; and (d) providing an ambidextrous finger pad affixed to the lower end of the vertical link; whereby vertical movement of said finger pad results in vertical movement of said vertical link and rotation of said enhanced bolt catch about said pivot pin.

14. The method of claim 13 wherein the vertical link is provided with a clearance hole in a mid-section of the vertical link approximately a diameter of a magazine button hole in the receiver, and elongated in the vertical direction, so that the vertical link can move freely, vertically, a predetermined amount, without interference from any button or shaft which might be installed in the magazine button hole.

15. The method of claim 14 wherein a magazine release is installed in the magazine button hole and resides passing through the clearance hole.

* * * * *